US009613572B2

(12) United States Patent
Lee

(10) Patent No.: US 9,613,572 B2
(45) Date of Patent: Apr. 4, 2017

(54) CONTROLLER AND METHOD FOR DIMMING LIGHT-EMITTING DIODES

(71) Applicant: Leadtrend Technology Corp., Hsin-Chu (TW)

(72) Inventor: Ching-Tsan Lee, Hsin-Chu (TW)

(73) Assignee: Leadtrend Technology Corp., Hsinchu County (TW)

( * ) Notice: Subject to any disclaimer, the term of this patent is extended or adjusted under 35 U.S.C. 154(b) by 0 days.

(21) Appl. No.: 14/733,978

(22) Filed: Jun. 9, 2015

(65) Prior Publication Data

US 2015/0359057 A1 Dec. 10, 2015

(30) Foreign Application Priority Data

Jun. 10, 2014 (TW) ..... 103120065 A

(51) Int. Cl.
*G09G 3/34* (2006.01)
*H05B 33/08* (2006.01)
*G09G 3/36* (2006.01)

(52) U.S. Cl.
CPC ..... *G09G 3/3406* (2013.01); *H05B 33/0815* (2013.01); *H05B 33/0851* (2013.01); *G09G 3/36* (2013.01); *G09G 2320/064* (2013.01); *G09G 2320/0666* (2013.01)

(58) Field of Classification Search
CPC ..... G09G 2300/0842; H05B 33/0815; H05B 41/2821
See application file for complete search history.

(56) References Cited

U.S. PATENT DOCUMENTS

2009/0302779 A1* 12/2009 McKinney ..... H05B 33/0818 315/294
2012/0206064 A1* 8/2012 Archenhold ..... H05B 33/0812 315/297
2013/0300310 A1* 11/2013 Hu ..... H05B 33/0854 315/239
2015/0208469 A1* 7/2015 Coetzee ..... H02M 1/36 315/307
2015/0264769 A1* 9/2015 Jelaca ..... H05B 33/0845 315/206

* cited by examiner

*Primary Examiner* — Ricardo L Osorio
(74) *Attorney, Agent, or Firm* — Winston Hsu; Scott Margo

(57) ABSTRACT

A controller for dimming light-emitting diodes includes a pulse width modulation pin, a low-pass filter, a frequency detection unit, and a control signal generation module. The low-pass filter generates a direct current signal according to a pulse width modulation signal generated by a micro-controller. The frequency detection unit generates a logic value according to a threshold and the pulse width modulation signal. The control signal generation module generates a switch control signal to a first switch connected to the light-emitting diodes in series according to the direct current signal, the logic value, a reference voltage, and the pulse width modulation signal. When a frequency of the pulse width modulation signal is lower than the threshold, the controller enters a digital dimming mode; and when the frequency of the pulse width modulation signal is higher than the threshold, the controller enters an analog dimming mode.

12 Claims, 6 Drawing Sheets

CONTROLLER AND METHOD FOR DIMMING LIGHT-EMITTING DIODES

BACKGROUND OF THE INVENTION

1. Field of the Invention

The present invention relates to a controller for dimming light-emitting diodes and a method for dimming light-emitting diodes, and particularly to a controller for dimming light-emitting diodes and a method for dimming light-emitting diodes that can execute a digital dimming mode or an analog dimming mode on the same pin according to a frequency of a pulse width modulation signal.

2. Description of the Prior Art

A digital dimming mode and an analog dimming mode applied to dimming light-emitting diodes have own advantages, respectively. For example, the analog dimming mode has advantages as follows: first, the analog dimming mode has better color saturation; second, power consumption of the analog dimming mode is lower, so the analog dimming mode has more flexible product design for new energy legislation (e.g. level-6); third, the analog dimming mode does not generate moiré, so the analog dimming mode is friendly to human eyes, that is, the analog dimming mode has buzz marketing; fourth, a frequency of an electromagnetic wave corresponding to the analog dimming mode falls within a range (1 Hz-30 kHz) specified by Swedish Federation of Professional Employees (TCO). In addition, the digital dimming mode also has advantages as follows: first, the digital dimming mode has better contrast; second, color temperature and color cast corresponding to the digital dimming mode are more controlled easily; third, luminance and driving current of light-emitting diodes generated according to the digital dimming mode are varied lineally.

In the prior art, because the digital dimming mode and the analog dimming mode have own advantages respectively, although a user can set a driving circuit for driving light-emitting diodes to operate the digital dimming mode or the analog dimming mode through different corresponding external signals, the driving circuit needs to have different pins to receive an external signal corresponding to the digital dimming mode or an external signal corresponding to the analog dimming mode, or modify a printed circuit board which the driving circuit is installed in accordingly, resulting in the prior art is not a good choice for the user.

SUMMARY OF THE INVENTION

A first embodiment of the present invention provides a controller for dimming light-emitting diodes. The controller includes a pulse width modulation pin, a low-pass filter, a frequency detection unit, and a control signal generation module. The pulse width modulation pin is used for receiving a pulse width modulation signal generated by a micro-controller. The low-pass filter is used for generating a direct current signal according to the pulse width modulation signal. The frequency detection unit is used for generating a logic value according to a threshold and the pulse width modulation signal. The control signal generation module is coupled to the low-pass filter and the frequency detection unit for generating a switch control signal to a first switch connected to the light-emitting diodes in series according to the direct current signal, the logic value, a reference voltage, and the pulse width modulation signal, wherein the first switch is turned on and off according to the switch control signal. When a frequency of the pulse width modulation signal is lower than the threshold, the controller enters a digital dimming mode, and when the frequency of the pulse width modulation signal is higher than the threshold, the controller enters an analog dimming mode.

A second embodiment of the present invention provides a method for dimming light-emitting diodes, wherein a controller applied to the method includes a pulse width modulation pin, a low-pass filter, a frequency detection unit, and a control signal generation module. The method includes the pulse width modulation pin receiving a pulse width modulation signal generated by a micro-controller; the low-pass filter generating a direct current signal according to the pulse width modulation signal; the frequency detection unit generating a logic value according to a threshold and the pulse width modulation signal; the control signal generation module generating a switch control signal to a first switch connected to the light-emitting diodes in series according to the direct current signal, the logic value, a reference voltage, and the pulse width modulation signal, wherein the first switch is turned on and off according to the switch control signal. When the frequency of the pulse width modulation signal is lower than the threshold, the controller enters a digital dimming mode, and when the frequency of the pulse width modulation signal is higher than the threshold, the controller enters an analog dimming mode.

A third embodiment of the present invention provides a method for dimming light-emitting diodes, wherein the light-emitting diodes are applied to a liquid crystal display, and a controller applied to the method includes a pulse width modulation pin, a low-pass filter, a frequency detection unit, and a control signal generation module, wherein the control signal generation module includes a multiplexer, a logic unit, a transmission unit, a second switch, and a comparator. The method includes the pulse width modulation pin receiving a pulse width modulation signal generated by a micro-controller according to image signals received by the liquid crystal display; the low-pass filter generating a direct current signal according to the pulse width modulation signal; the frequency detection unit generating a logic value according to a threshold and the pulse width modulation signal; the control signal generation module generating a switch control signal to a first switch connected to the light-emitting diodes in series according to the direct current signal, the logic value, a reference voltage, and the pulse width modulation signal, wherein the first switch is turned on and off according to the switch control signal. When the frequency of the pulse width modulation signal is lower than the threshold, the controller enters a digital dimming mode, and when the frequency of the pulse width modulation signal is higher than the threshold, the controller enters an analog dimming mode.

The present invention provides a controller for dimming light-emitting diodes and a method for dimming light-emitting diodes. The controller and the method determine the controller to operate in a digital dimming mode or an analog dimming mode according to a pulse width modulation signal generated by a micro-controller and a threshold, so the present invention needs only one pin to receive the pulse width modulation signal generated by the micro-controller to make the controller switch the digital dimming mode and the analog dimming mode each other according to the pulse width modulation signal and the threshold. Therefore, compared to the prior art, because the present invention determines the controller to operate the digital dimming mode or the analog dimming mode according to the pulse width modulation signal generated by the micro-controller and the threshold, the present invention does not need modify a printed circuit board which the controller is installed in accordingly. In addition, the present invention determines the controller to operate the digital dimming mode or the analog dimming mode according to the pulse width modulation signal generated by the micro-controller and the threshold, so the present invention does not increase additional burden.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
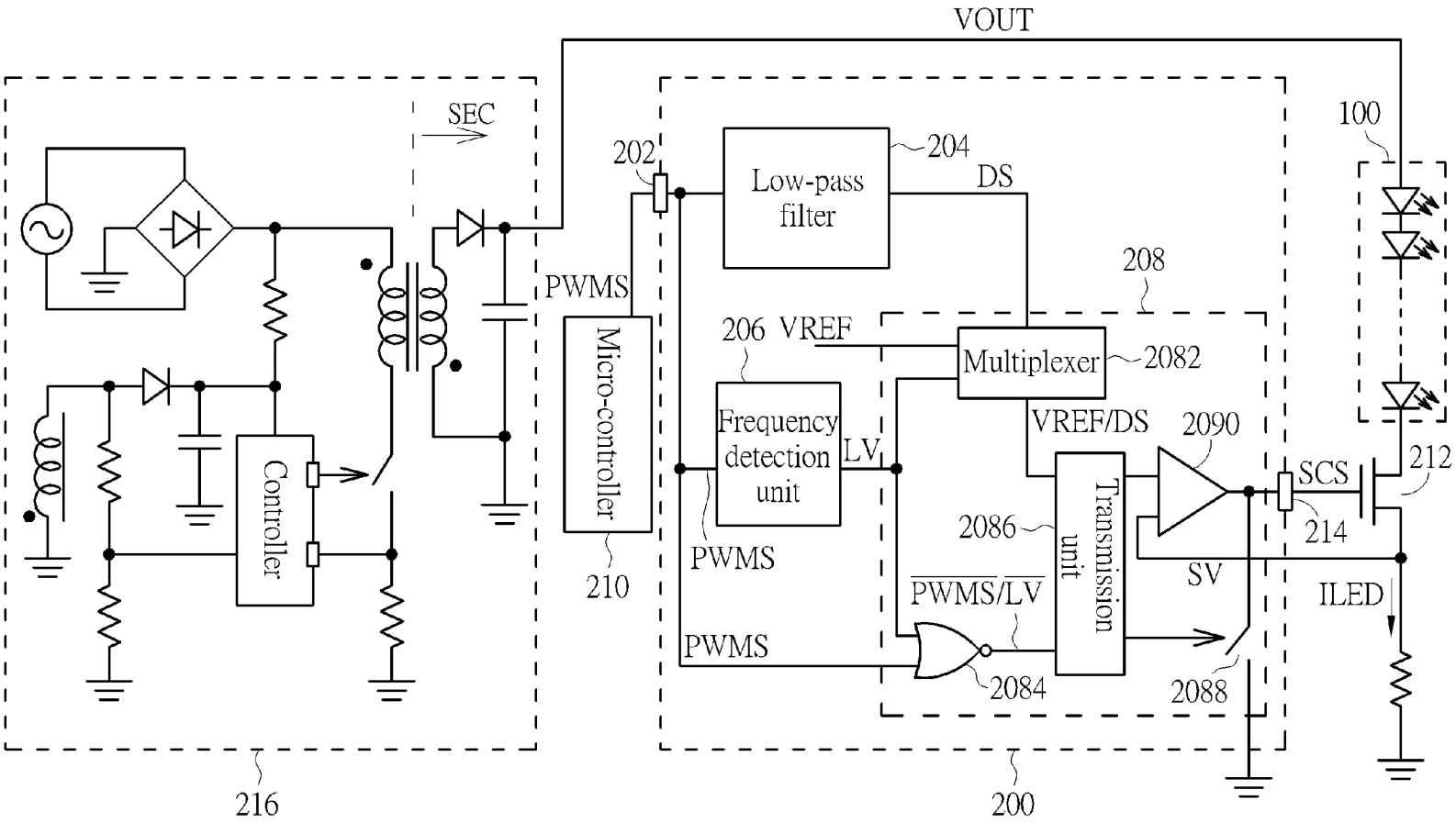
FIG. 1 is a diagram illustrating a controller for dimming light-emitting diodes according to a first embodiment of the present invention.

Please refer to FIG. 1. FIG. 1 is a diagram illustrating a controller 200 for dimming light-emitting diodes 100 according to a first embodiment of the present invention, wherein a secondary side SEC of a power converter 216 is use for generating an output voltage VOUT to drive the light-emitting diodes 100, and the controller 200 is applied to the secondary side SEC of the power converter 216. As shown in FIG. 1, the controller 200 includes a pulse width modulation pin 202, a low-pass filter 204, a frequency detection unit 206, and a control signal generation module 208. As shown in FIG. 1, the pulse width modulation pin 202 is used for receiving a pulse width modulation signal PWMS generated by a micro-controller 210. The low-pass filter 204 is coupled to the pulse width modulation pin 202 for generating a direct current signal DS according to the pulse width modulation signal PWMS. The frequency detection unit 206 is coupled to the pulse width modulation pin 202 for generating a logic value LV according to a threshold and the pulse width modulation signal PWMS. For example, when a frequency of the pulse width modulation signal PWMS is lower than the threshold, the frequency detection unit 206 generates a logic value "0", and when the frequency of the pulse width modulation signal PWMS is higher than the threshold, the frequency detection unit 206 generates a logic value "1". But, the present invention is not limited to the frequency detection unit 206 generating the logic value "0" when the frequency of the pulse width modulation signal PWMS is lower than the threshold, and the frequency detection unit 206 generating the logic value "1" when the frequency of the pulse width modulation signal PWMS is higher than the threshold. The control signal generation module 208 is coupled to the low-pass filter 204 and the frequency detection unit 206 for generating a switch control signal SCS to a first switch 212 connected to the light-emitting diodes 100 in series according to the direct current signal DS, the logic value LV, a reference voltage VREF, and the pulse width modulation signal PWMS, wherein the first switch 212 is turned on and off according to the switch control signal SCS, and the switch control signal SCS is transmitted to the first switch 212 through a gate pin 214.

As shown in FIG. 1, the control signal generation module 208 includes a multiplexer 2082, a logic unit 2084, a transmission unit 2086, a second switch 2088, and a comparator 2090. As shown in FIG. 1, the multiplexer 2082 is coupled to the low-pass filter 204 and the frequency detection unit 206 for outputting the reference voltage VREF or the direct current signal DS according to the logic value LV, wherein when the frequency of the pulse width modulation signal PWMS is lower than the threshold, the multiplexer 2082 outputs the reference voltage VREF, and when the frequency of the pulse width modulation signal PWMS is higher than the threshold, the multiplexer 2082 outputs the direct current signal DS. The logic unit 2084 is coupled to the frequency detection unit 206 for receiving the pulse width modulation signal PWMS and the logic value LV, and outputting an inverse pulse width modulation signal $\overline{\text{PWMS}}$ or a first logic value $\overline{\text{LV}}$ which is inverse to the logic value LV, wherein when the frequency of the pulse width modulation signal PWMS is lower than the threshold, the logic unit 2084 outputs the inverse pulse width modulation signal $\overline{\text{PMWS}}$, and when the frequency of the pulse width modulation signal PWMS is higher than the threshold, the logic unit 2084 outputs the first logic value $\overline{\text{LV}}$. The transmission unit 2086 is coupled to the multiplexer 2082 and the logic unit 2084 for outputting one of the reference voltage VREF and the direct current signal DS, and outputting one of the inverse pulse width modulation signal $\overline{\text{PWMS}}$ and the first logic value $\overline{\text{LV}}$. The second switch 2088 is coupled to the transmission unit 2086 for executing a corresponding operation according to the inverse pulse width modulation signal $\overline{\text{PWMS}}$ or the first logic value $\overline{\text{LV}}$, wherein when the second switch 2088 is turned on, the first switch 212 is turned off, and when the second switch 2086 is turned off, the first switch 212 is turned on. The comparator 2090 is coupled to the transmission unit 2086 for generating the switch control signal SCS to the first switch 212 according to one of the reference voltage VREF and the direct current signal DS, and a sensing voltage SV.

As shown in FIG. 1, when the frequency of the pulse width modulation signal PWMS is lower than the threshold, the multiplexer 2082 outputs the reference voltage VREF, and the frequency detection unit 206 generates the logic value "0" according to the threshold and the frequency of the pulse width modulation signal PWMS. The logic unit 2084 outputs the inverse pulse width modulation signal $\overline{\text{PWMS}}$ according to the logic value "0" and the pulse width modulation signal PWMS. The transmission unit 2086 outputs the reference voltage VREF, and outputs the inverse pulse width modulation signal $\overline{\text{PWMS}}$. The second switch 2088 is turned on and off according to the inverse pulse width modulation signal $\overline{\text{PWMS}}$, wherein when the second switch 2088 is turned on, the first switch 212 is turned off, and when the second switch 2088 is turned off, the first switch 212 is turned on. The comparator 2090 generates the switch control signal SCS to the first switch 212 according to the reference voltage VREF and the sensing voltage SV. Because the second switch 2088 is turned on and off according to the inverse pulse width modulation signal $\overline{\text{PWMS}}$, the first switch 212 is also turned on and off according to the inverse pulse width modulation signal $\overline{\text{PWMS}}$, resulting in the controller 200 enters a digital dimming mode. Therefore, when the frequency of the pulse width modulation signal PWMS is lower than the threshold, the controller 200 enters the digital dimming mode. That is to say, when the comparator 2090 generates the switch control signal SCS to the first switch 212 according to the reference voltage VREF and the sensing voltage SV, the controller 200 enters the digital dimming mode.

As shown in FIG. 1, when the frequency of the pulse width modulation signal PWMS is higher than the threshold, the multiplexer 2082 outputs the direct current signal DS, and the frequency detection unit 206 generates the logic value "1" according to the threshold and the frequency of the pulse width modulation signal PWMS. The logic unit 2084 outputs the first logic value "0" which is inverse to the logic value "1" according to the logic value "1" and the pulse width modulation signal PWMS. The transmission unit 2086 outputs the direct current signal DS, and outputs the first logic value "0". The second switch 2088 is turned off according to the first logic value "0", wherein when the second switch 2088 is turned off, the first switch 212 is turned on. The comparator 2090 generates the switch control signal SCS to the first switch 212 according to the direct current signal DS and the sensing voltage SV. Because the second switch 2088 keeps being turned off according to the first logic value "0", the first switch 212 can keep being turned on according to the switch control signal SCS (corresponding to the direct current signal DS), resulting in the controller 200 entering an analog dimming mode. Therefore, when the frequency of the pulse width modulation signal PWMS is higher than the threshold, the controller 200 enters the analog dimming mode. That is to say, when the comparator 2090 generates the switch control signal SCS to the first switch 212 according to the direct current signal DS and the sensing voltage SV, the controller 200 enters the analog dimming mode.

Figure 2:
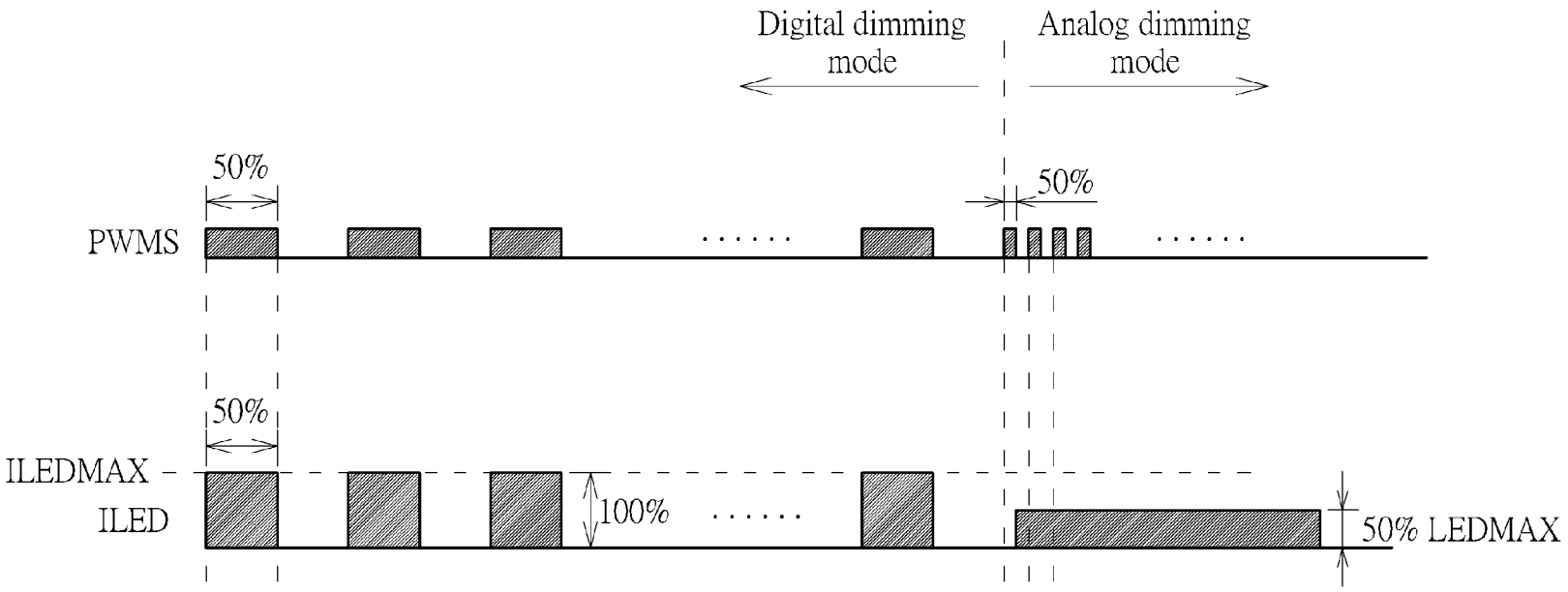
FIG. 2 is a diagram illustrating a relationship between the pulse width modulation signal and a driving current flowing through the light-emitting diodes.

Please refer to FIG. 2. FIG. 2 is a diagram illustrating a relationship between the pulse width modulation signal PWMS and a driving current ILED flowing through the light-emitting diodes 100. As shown in FIG. 2, when the frequency of the pulse width modulation signal PWMS is lower than the threshold, the controller 200 enters the digital dimming mode. If a duty cycle of the pulse width modulation signal PWMS is 50%, a duty cycle of the driving current ILED is also 50%; when the frequency of the pulse width modulation signal PWMS is higher than the threshold, the controller 200 enters the analog dimming mode. If the duty cycle of the pulse width modulation signal PWMS is 50%, the driving current ILED is 50% of a maximum driving current ILEDMAX.

In addition, the present invention is not limited to the controller 200 only having two dimming modes. That is to say, the frequency detection unit 206 can generate a corresponding logic value according to more than one threshold and the frequency of the pulse width modulation signal PWMS. For example, when the frequency of the pulse width modulation signal PWMS is lower than a first threshold, the frequency detection unit 206 can generate a logic value "00"; when the frequency of the pulse width modulation signal PWMS is between the first threshold and a second threshold, the frequency detection unit 206 can generate a logic value "01"; and when the frequency of the pulse width modulation signal PWMS is higher than the second threshold, the frequency detection unit 206 can generate a logic value "10". Meanwhile, the multiplexer 2082 and the logic unit 2084 can adjust outputs accordingly according to the above mentioned logic values ("00", "01", "10") generated by the frequency detection unit 206 to make the controller 200 have three dimming modes.

In addition, the present invention can preset the controller 200 to enter the digital dimming mode or the analog dimming mode when the controller 200 is powered on, or when the controller 200 operates normally, the controller 200 can switch the digital dimming mode to the analog dimming mode, or switch the analog dimming mode to the digital dimming mode according to the pulse width modulation signal PWMS.

Figure 3A:
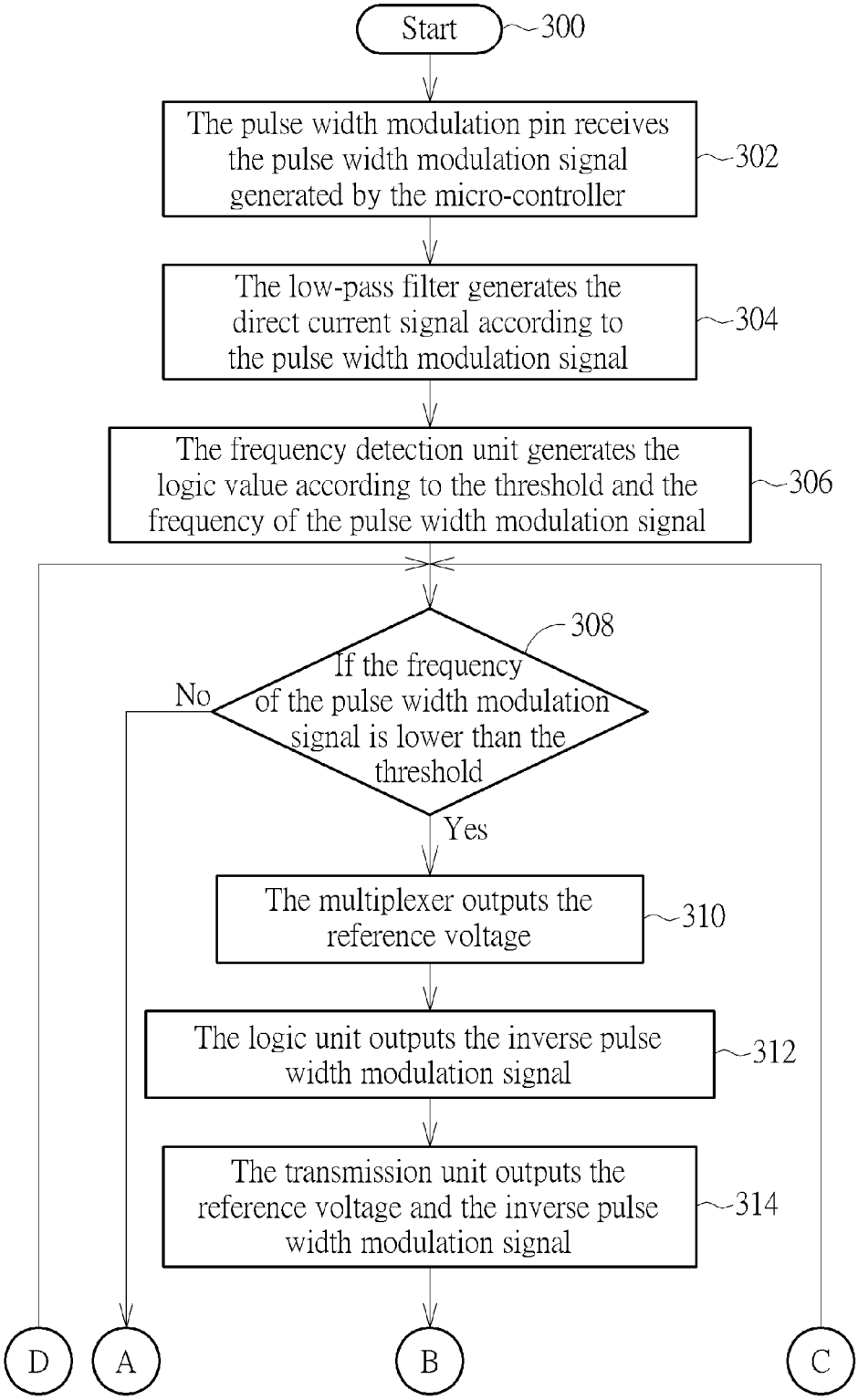
FIG. 3A and FIG. 3B are flowcharts illustrating a method for dimming light-emitting diodes according to a second embodiment of the present invention.
Figure 3B:
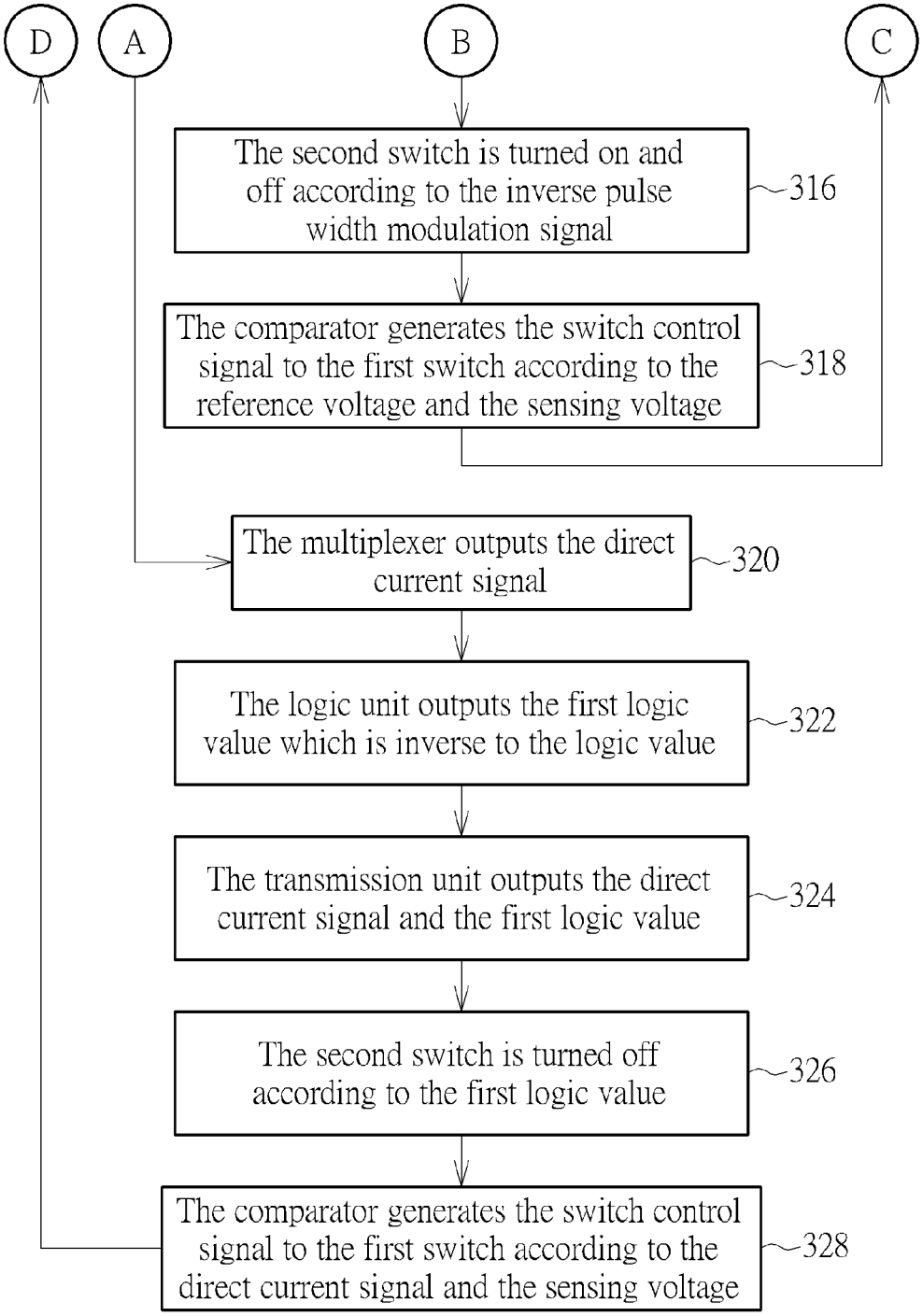

Please refer to FIG. 1, FIG. 3A, and FIG. 3B. FIG. 3A and FIG. 3B are flowcharts illustrating a method for dimming light-emitting diodes according to a second embodiment of the present invention. The method in FIG. 3A and FIG. 3B is illustrated using the controller 200 in FIG. 1. Detailed steps are as follows:

Step 300: Start.

Step 302: The pulse width modulation pin 202 receives the pulse width modulation signal PWMS generated by the micro-controller 210.

Step 304: The low-pass filter 204 generates the direct current signal DS according to the pulse width modulation signal PWMS.

Step 306: The frequency detection unit 206 generates the logic value LV according to the threshold and the frequency of the pulse width modulation signal PWMS.

Step 308: If the frequency of the pulse width modulation signal PWMS is lower than the threshold; if yes, go to Step 310; if no, go to Step 320.

Step 310: The multiplexer 2082 outputs the reference voltage VREF.

Step 312: The logic unit 2084 outputs the inverse pulse width modulation signal $\overline{PWMS}$.

Step 314: The transmission unit 2086 outputs the reference voltage VREF and the inverse pulse width modulation signal $\overline{PWMS}$.

Step 316: The second switch 2088 is turned on and off according to the inverse pulse width modulation signal $\overline{PWMS}$.

Step 318: The comparator 2090 generates the switch control signal SCS to the first switch 212 according to the reference voltage VREF and the sensing voltage SV, go to Step 308.

Step 320: The multiplexer 2082 outputs the direct current signal DS.

Step 322: The logic unit 2084 outputs the first logic value $\overline{LV}$ which is inverse to the logic value LV.

Step 324: The transmission unit 2086 outputs the direct current signal DS and the first logic value $\overline{LV}$.

Step 326: The second switch 2088 is turned off according to the first logic value $\overline{LV}$.

Step 328: The comparator 2090 generates the switch control signal SCS to the first switch 212 according to the direct current signal DS and the sensing voltage SV, go to Step 308.

In Step 306, the frequency detection unit 206 generates the logic value LV according to the threshold and the pulse width modulation signal PWMS. For example, when the frequency of the pulse width modulation signal PWMS is lower than the threshold, the frequency detection unit 206 generates the logic value "0", and when the frequency of the pulse width modulation signal PWMS is higher than the threshold, the frequency detection unit 206 generates the logic value "1". But, the present invention is not limited to the frequency detection unit 206 generating the logic value "0" when the frequency of the pulse width modulation signal PWMS is lower than the threshold, and the frequency detection unit 206 generating the logic value "1" when the frequency of the pulse width modulation signal PWMS is higher than the threshold.

In Step 310, when the frequency of the pulse width modulation signal PWMS is lower than the threshold, the multiplexer 2082 outputs the reference voltage VREF, and the frequency detection unit 206 generates the logic value "0" according to the threshold and the pulse width modulation signal PWMS. In Step 312, the logic unit 2084 outputs the inverse pulse width modulation signal $\overline{PWMS}$ according to the logic value "0" and the pulse width modulation signal PWMS; in Step 316, the second switch 2088 is turned on and off according to the inverse pulse width modulation signal $\overline{PWMS}$, wherein when the second switch 2088 is turned on, the first switch 212 is turned off, and when the second switch 2088 is turned off, the first switch 212 is turned on; in Step 318, the comparator 2090 generates the switch control signal SCS to the first switch 212 according to the reference voltage VREF and the sensing voltage SV. Because the second switch 2088 is turned on and off according to the inverse pulse width modulation signal $\overline{PWMS}$, the first switch 212 is also turned on and off according to the inverse pulse width modulation signal $\overline{PWMS}$, resulting in the controller 200 enters the digital dimming mode. Therefore, when the frequency of the pulse width modulation signal PWMS is lower than the threshold, the controller 200 enters the digital dimming mode. That is to say, when the comparator 2090 generates the switch control signal SCS to the first switch 212 according to the reference voltage VREF and the sensing voltage SV, the controller 200 enters the digital dimming mode.

In Step 320, when the frequency of the pulse width modulation signal PWMS is higher than the threshold, the multiplexer 2082 outputs the direct current signal DS, and the frequency detection unit 206 generates the logic value "1" according to the threshold and the frequency of the pulse width modulation signal PWMS. In Step 322, the logic unit 2084 outputs the first logic value "0" which is inverse to the logic value "1" according to the logic value "1" and the pulse width modulation signal PWMS; in Step 326, the second switch 2088 is turned off according to the first logic value "0", wherein when the second switch 2088 is turned off, the first switch 212 is turned on; in Step 328, the comparator 2090 generates the switch control signal SCS to the first switch 212 according to the direct current signal DS and the sensing voltage SV. Because the second switch 2088 keeps being turned off according to the first logic value "0", the first switch 212 can keep being turned on according to the switch control signal SCS (corresponding to the direct current signal DS), resulting in the controller 200 entering the analog dimming mode. Therefore, when the frequency of the pulse width modulation signal PWMS is higher than the threshold, the controller 200 enters the analog dimming mode. That is to say, when the comparator 2090 generates the switch control signal SCS to the first switch 212 according to the direct current signal DS and the sensing voltage SV, the controller 200 enters the analog dimming mode.

Figure 4A:
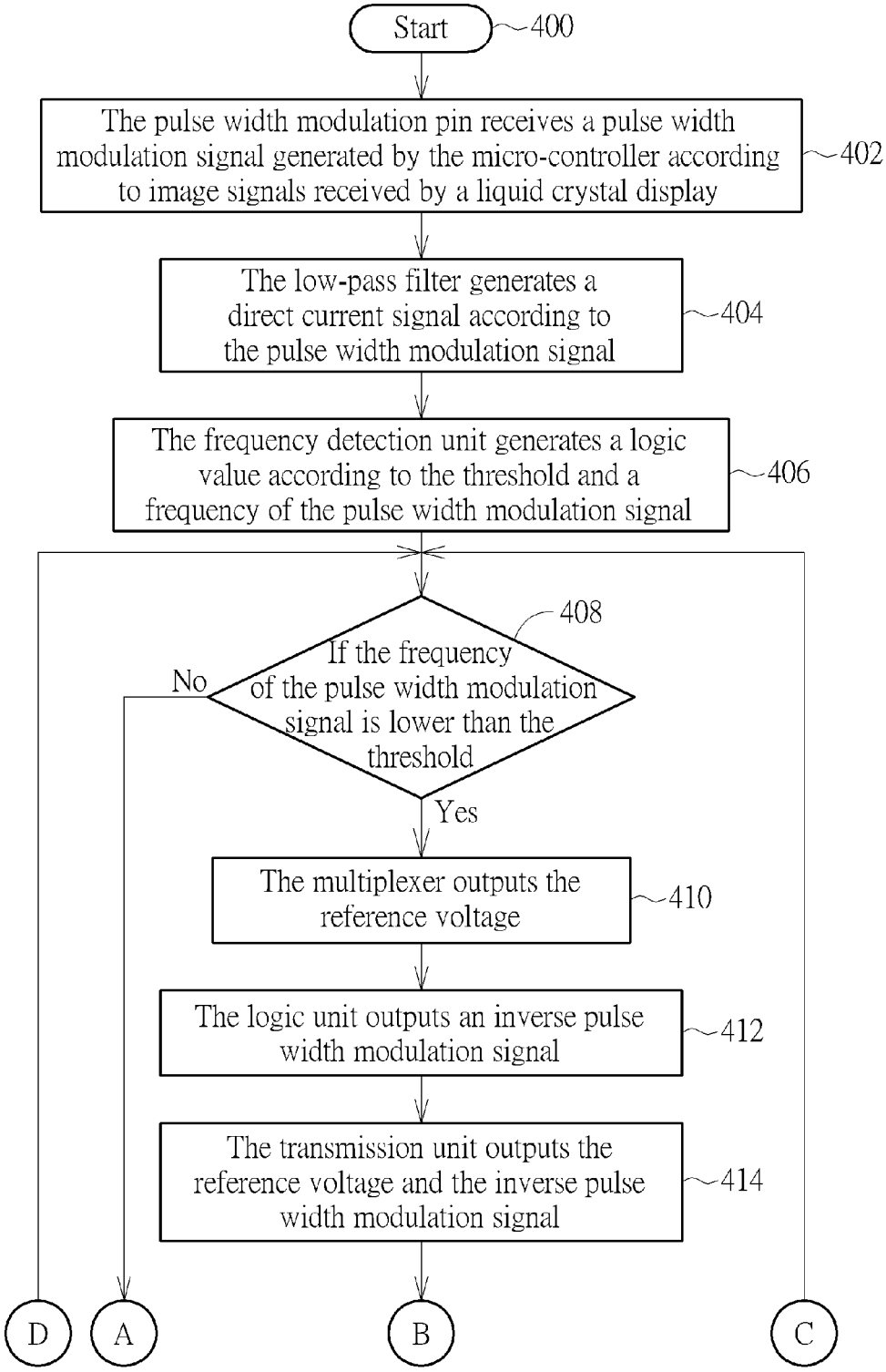
FIG. 4A and FIG. 4B are flowcharts illustrating a method for dimming light-emitting diodes according to a third embodiment of the present invention.
Figure 4B:
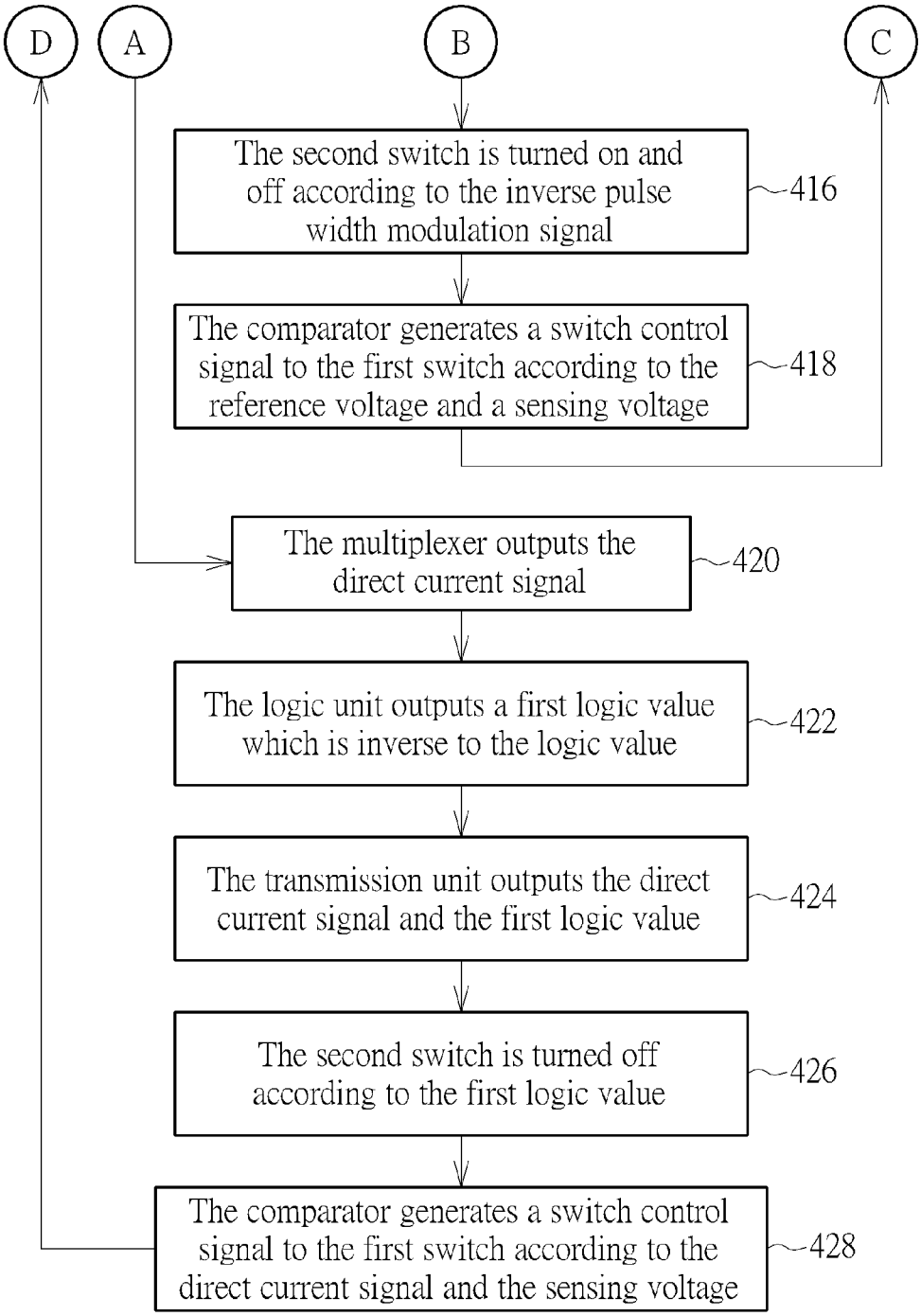

Please refer to FIG. 1, FIG. 4A, and FIG. 4B. FIG. 4A and FIG. 4B are flowcharts illustrating a method for dimming light-emitting diodes according to a third embodiment of the present invention. The method in FIG. 4A and FIG. 4B is illustrated using the controller 200 in FIG. 1. Detailed steps are as follows:

Step 400: Start.

Step 402: The pulse width modulation pin 202 receives a pulse width modulation signal PWMS generated by the micro-controller 210 according to image signals received by a liquid crystal display;

Step 404: The low-pass filter 204 generates a direct current signal DS according to the pulse width modulation signal PWMS.

Step 406: The frequency detection unit 206 generates a logic value LV according to the threshold and a frequency of the pulse width modulation signal PWMS.

Step 408: If the frequency of the pulse width modulation signal PWMS is lower than the threshold; if yes, go to Step 410; if no, go to Step 420.

Step 410: The multiplexer 2082 outputs the reference voltage VREF.

Step 412: The logic unit 2084 outputs an inverse pulse width modulation signal $\overline{PWMS}$.

Step 414: The transmission unit 2086 outputs the reference voltage VREF and the inverse pulse width modulation signal $\overline{PWMS}$.

Step 416: The second switch 2088 is turned on and off according to the inverse pulse width modulation signal $\overline{PWMS}$.

Step 418: The comparator 2090 generates a switch control signal SCS to the first switch 212 according to the reference voltage VREF and a sensing voltage SV, go to Step 408.

Step 420: The multiplexer 2082 outputs the direct current signal DS.

Step 422: The logic unit 2084 outputs a first logic value $\overline{LV}$ which is inverse to the logic value LV.

Step 424: The transmission unit 2086 outputs the direct current signal DS and the first logic value $\overline{LV}$.

Step 426: The second switch 2088 is turned off according to the first logic value $\overline{LV}$.

Step 428: The comparator 2090 generates a switch control signal SCS to the first switch 212 according to the direct current signal DS and the sensing voltage SV, go to Step 408.

A difference between the embodiment in FIG. 4A and FIG. 4B and the embodiment in FIG. 3A and FIG. 3B is that in Step 402, the micro-controller 210 generates the pulse width modulation signal PWMS according to the image signals received by the liquid crystal display, wherein the pulse width modulation signal PWMS corresponds to various playback modes, a variety of contrast, or a variety of white balance of the liquid crystal display, and the various playback modes of the liquid crystal display include a move mode, a game mode, a three-dimensional mode, and a two-dimensional mode. In the embodiment in FIG. 4A and FIG. 4B, because the micro-controller 210 can generate the pulse width modulation signal PWMS according to the image signals received by the liquid crystal display, the micro-controller 210 can generate the pulse width modulation signal PWMS according to the driving current ILED flowing through the light-emitting diodes 100 corresponding to the image signals received by the liquid crystal display. For example, when the image signals received by the liquid crystal display needs the larger driving current ILED, the micro-controller 210 can generate the pulse width modulation signal PWMS with the lower frequency. In addition, subsequent operational principles of the embodiment in FIG. 4A and FIG. 4B are the same as those of the embodiment in FIG. 3A and FIG. 3B, so further description thereof is omitted for simplicity.

To sum up, the controller for dimming light-emitting diodes and the method for dimming light-emitting diodes determine the controller to operate in the digital dimming mode or the analog dimming mode according to the pulse width modulation signal generated by the micro-controller and the threshold, so the present invention needs only one pin to receive the pulse width modulation signal generated by the micro-controller to make the controller switch the digital dimming mode and the analog dimming mode each other according to the pulse width modulation signal and the threshold. Therefore, compared to the prior art, because the present invention determines the controller to operate the digital dimming mode or the analog dimming mode according to the pulse width modulation signal generated by the micro-controller and the threshold, the present invention does not need modify a printed circuit board which the controller is installed in accordingly. In addition, the present invention determines the controller to operate the digital dimming mode or the analog dimming mode according to the pulse width modulation signal generated by the micro-controller and the threshold, so the present invention does not increase additional burden.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A controller for dimming light-emitting diodes, comprising:

a pulse width modulation pin for receiving a pulse width modulation signal generated by a micro-controller;

a low-pass filter for generating a direct current signal according to the pulse width modulation signal;

a frequency detection unit for generating a logic value according to a threshold and the pulse width modulation signal; and a control signal generation module coupled to the low-pass filter and the frequency detection unit for generating a switch control signal to a first switch connected to the light-emitting diodes in series according to the direct current signal, the logic value, a reference voltage, and the pulse width modulation signal, wherein the first switch is turned on and off according to the switch control signal, wherein the control signal generation module comprises:

a multiplexer coupled to the low-pass filter and the frequency detection unit for outputting the reference voltage or the direct current signal according to the logic value, wherein when a frequency of the pulse width modulation signal is lower than the threshold, the multiplexer outputs the reference voltage, and when the frequency of the pulse width modulation signal is higher than the threshold, the multiplexer outputs the direct current signal;

a logic unit coupled to the frequency detection unit for receiving the pulse width modulation signal and the logic value, and outputting an inverse pulse width modulation signal or a first logic value which is inverse to the logic value, wherein when the frequency of the pulse width modulation signal is lower than the threshold, the logic unit outputs the inverse pulse width modulation signal, and when the frequency of the pulse width modulation signal is higher than the threshold, the logic unit outputs the first logic value;

a transmission unit coupled to the multiplexer and the logic unit for outputting one of the reference voltage and the direct current signal, and outputting one of the inverse pulse width modulation signal and the first logic value;

a second switch coupled to the transmission unit for executing a corresponding operation according to the inverse pulse width modulation signal or the first logic value, wherein when the second switch is turned on, the first switch is turned off, and when the second switch is turned off, the first switch is turned on; and a comparator coupled to the transmission unit for generating the switch control signal to the first switch according to one of the reference voltage and the direct current signal, and a sensing voltage;

wherein when the comparator generates the switch control signal to the first switch according to the reference voltage and the sensing voltage, the controller enters the digital dimming mode, and when the comparator generates the switch control signal to the first switch according to the direct current signal and the sensing voltage, the controller enters the analog dimming mode;

wherein when a frequency of the pulse width modulation signal is lower than the threshold, the controller enters a digital dimming mode, and when the frequency of the pulse width modulation signal is higher than the threshold, the controller enters an analog dimming mode.

2. The controller of claim 1, wherein when the controller is powered on, the controller is preset to enter the digital dimming mode or the analog dimming mode.

3. The controller of claim 1, wherein when the controller operates normally, the controller switches the digital dimming mode to the analog dimming mode, or switches the analog dimming mode to the digital dimming mode according to the pulse width modulation signal and the threshold.

4. The controller of claim 1, wherein the switch control signal is transmitted to the first switch through a gate pin.

5. A method for dimming light-emitting diodes, wherein a controller applied to the method comprises a pulse width modulation pin, a low-pass filter, a frequency detection unit, and a control signal generation module, wherein the control signal generation module comprises a multiplexer, a logic unit, a transmission unit, a second switch, and a comparator, the method comprising:

the pulse width modulation pin receiving a pulse width modulation signal generated by a micro-controller;

the low-pass filter generating a direct current signal according to the pulse width modulation signal;

the frequency detection unit generating a logic value according to a threshold and the pulse width modulation signal;

the multiplexer outputting a reference voltage when a frequency of the pulse width modulation signal is lower than the threshold;

the logic unit outputting an inverse pulse width modulation signal when the frequency of the pulse width modulation signal is lower than the threshold;

the transmission unit outputting the reference voltage and the inverse pulse width modulation signal;

the second switch being turned on and off according to the inverse pulse width modulation signal, wherein when the second switch is turned on, a first switch is turned off, when the second switch is turned off, the first switch is turned on, and the first switch is connected to the light-emitting diodes in series; and the comparator generating a switch control signal to the first switch according to the reference voltage and a sensing voltage;

wherein when the comparator generates the switch control signal to the first switch according to the reference voltage and the sensing voltage, the controller enters a digital dimming mode, and the first switch is turned on and off according to the switch control signal;

wherein when the frequency of the pulse width modulation signal is lower than the threshold, the controller enters the digital dimming mode, and when the frequency of the pulse width modulation signal is higher than the threshold, the controller enters an analog dimming mode.

6. The method of claim 5, further comprising:

the multiplexer outputting the direct current signal when the frequency of the pulse width modulation signal is higher than the threshold;

the logic unit outputting a first logic value which is inverse to the logic value when the frequency of the pulse width modulation signal is higher than the threshold;

the transmission unit outputting the direct current signal and the first logic value;

the second switch being turned off according to the first logic value, wherein when the second switch is turned off, the first switch is turned on; and the comparator generating the switch control signal to the first switch according to the direct current signal and the sensing voltage;

wherein when the comparator generates the switch control signal to the first switch according to the direct current signal and the sensing voltage, the controller enters the analog dimming mode.

7. The method of claim 5, wherein when the controller is powered on, the controller is preset to enter the digital dimming mode or the analog dimming mode.

8. The method of claim 5, wherein when the controller operates normally, the controller switches the digital dimming mode to the analog dimming mode, or switches the analog dimming mode to the digital dimming mode according to the pulse width modulation signal and the threshold.

9. A method for dimming light-emitting diodes, wherein the light-emitting diodes are applied to a liquid crystal display, and a controller applied to the method comprises a pulse width modulation pin, a low-pass filter, a frequency detection unit, and a control signal generation module, wherein the control signal generation module comprises a multiplexer, a logic unit, a transmission unit, a second switch, and a comparator, the method comprising:

the pulse width modulation pin receiving a pulse width modulation signal generated by a micro-controller according to image signals received by the liquid crystal display;

the low-pass filter generating a direct current signal according to the pulse width modulation signal;

the frequency detection unit generating a logic value according to a threshold and the pulse width modulation signal;

the multiplexer outputting a reference voltage when a frequency of the pulse width modulation signal is lower than the threshold;

the logic unit outputting an inverse pulse width modulation signal when the frequency of the pulse width modulation signal is lower than the threshold;

the transmission unit outputting the reference voltage and the inverse pulse width modulation signal;

the second switch being turned on and off according to the inverse pulse width modulation signal, wherein when the second switch is turned on, a first switch is turned off, when the second switch is turned off, the first switch is turned on, and the first switch is connected to the light-emitting diodes in series; and the comparator generating a switch control signal to the first switch according to the reference voltage and a sensing voltage;

wherein when the comparator generates the switch control signal to the first switch according to the reference voltage and the sensing voltage, the controller enters a digital dimming mode, and the first switch is turned on and off according to the switch control signal;

wherein when the frequency of the pulse width modulation signal is lower than the threshold, the controller enters the digital dimming mode, and when the frequency of the pulse width modulation signal is higher than the threshold, the controller enters an analog dimming mode.

10. The method of claim 9, further comprising:

the multiplexer outputting the direct current signal when the frequency of the pulse width modulation signal is higher than the threshold;

the logic unit outputting a first logic value which is inverse to the logic value when the frequency of the pulse width modulation signal is higher than the threshold;

the transmission unit outputting the direct current signal and the first logic value;

the second switch being turned off according to the first logic value, wherein when the second switch is turned off, the first switch is turned on; and the comparator generating the switch control signal to the first switch according to the direct current signal and the sensing voltage;

wherein when the comparator generates the switch control signal to the first switch according to the direct current signal and the sensing voltage, the controller enters the analog dimming mode.

11. The method of claim 9, wherein the pulse width modulation signal corresponds to various playback modes, a variety of contrast, or a variety of white balance of the liquid crystal display.

12. The method of claim 11, wherein the various playback modes comprise a move mode, a game mode, a three-dimensional mode, and a two-dimensional mode.

* * * * *